United States Patent [19]

Horvath

[11] 4,408,702

[45] Oct. 11, 1983

[54] AUTOMATIC DISPENSER CAP

[76] Inventor: William Horvath, 10 Crestwood Dr., Watchung, N.J. 07060

[21] Appl. No.: 318,835

[22] Filed: Nov. 6, 1981

[51] Int. Cl.[3] ..... B05B 11/04

[52] U.S. Cl. ..... 222/212; 222/496

[58] Field of Search ..... 222/494, 496, 481, 545, 222/546, 212; D9/381, 378, 302; 220/18, DIG. 13

[56] References Cited

U.S. PATENT DOCUMENTS

| | | | |
|---|---|---|---|
| D. 246,156 | 10/1977 | Muscatiello et al. | D9/381 |
| 1,883,716 | 10/1932 | Greenlees | 222/496 |
| 3,874,563 | 4/1975 | Schwartzman | 222/496 X |
| 4,266,698 | 5/1981 | Rausing | 222/528 |

*Primary Examiner*—Stanley H. Tollberg
*Attorney, Agent, or Firm*—Martha G. Pugh

[57] ABSTRACT

An automatic dispensing cap for dispensing product contained in a squeeze-type container. A two-way valve-head comprising an upper disc closure is constructed so that it seats on the top edge of the inverted conical spout of the cap. In a preferred embodiment, the disc closure has a centrally-located air bore and depending tubular stem. Upon application of manual squeeze pressure, the valve-head unseats from the cap spout allowing product to flow through. When the squeeze pressure is released, a lower cruciform portion of the two-way valve-head acts as a spring to seat the upper disc closure, cutting off the flow of product, and allowing air to reenter the container through the central disc air bore and the tubular stem. An inverted cup-shaped check-valve closes the central air bore of the tubular stem during the dispensing phase, to prevent product from exiting therethrough. In another embodiment, primarily useful with a squeeze tube, the central disc and central stem are solid; and the check-valve is eliminated. An alternatively shaped container is disclosed which is designed to be hung in inverted position.

27 Claims, 9 Drawing Figures

FIG. 1
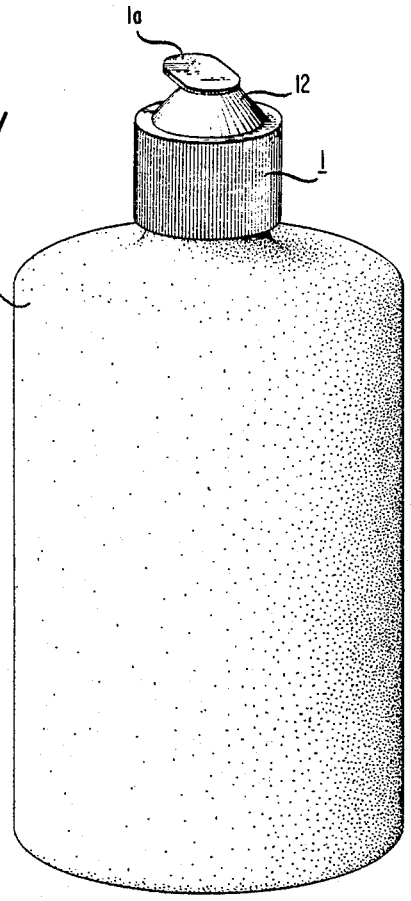
FIG. 5
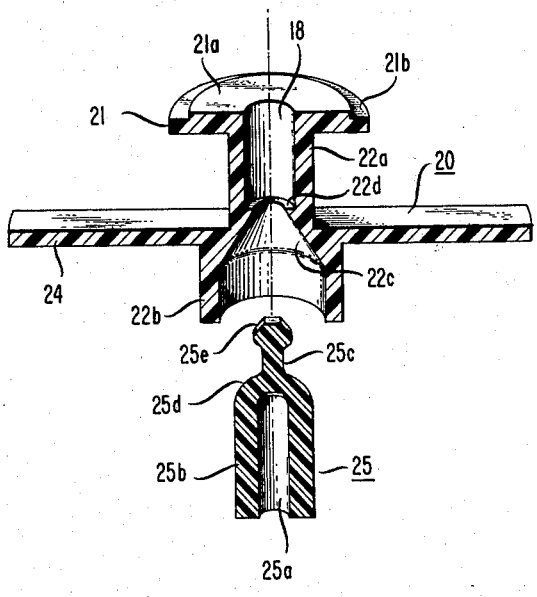
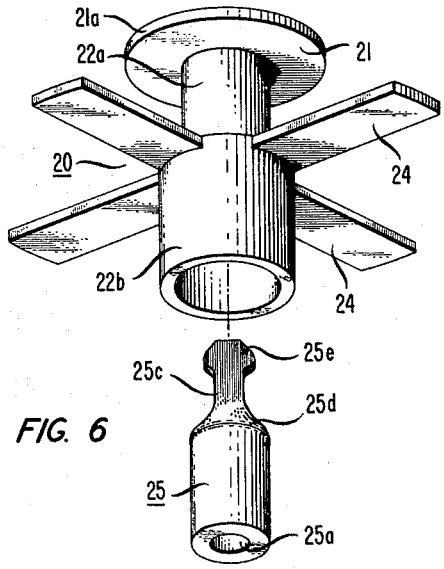
FIG. 6

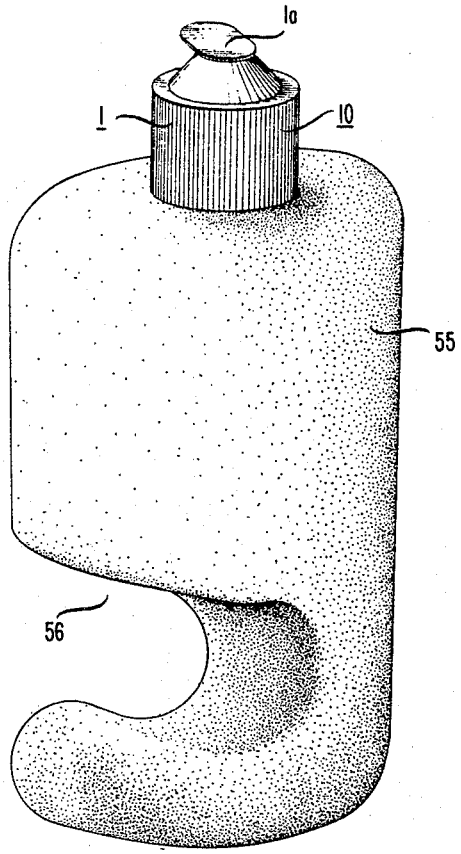
FIG. 7
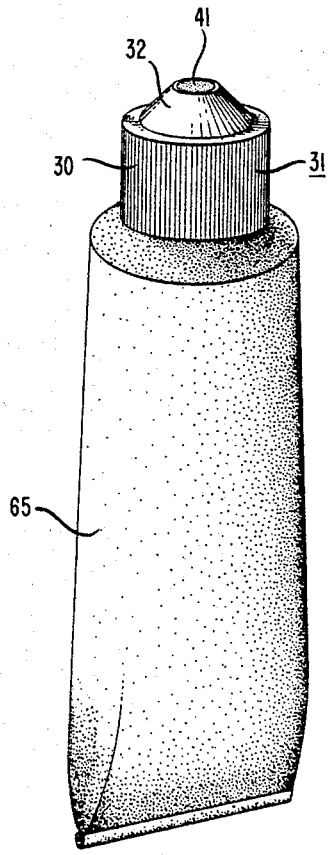
FIG. 8
FIG. 9
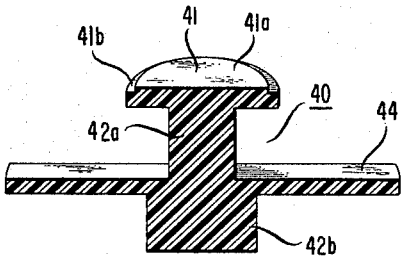

AUTOMATIC DISPENSER CAP

BACKGROUND OF THE INVENTION

This invention relates to automatic dispensing caps, and more particularly to dispensing caps employing two-way valves which allow product to flow out and air to flow in.

Heretofor, bottles for dispensing a wide range of items including household cleaners, foods and like products typically employed a cap which required removal each time the product was to be dispensed; and then, after dispensing, it was necessary to replace the cap to prevent spilling or evaporation.

Bottles and caps of this type are cumbersome, as when the cap is removed, the bottle is open and susceptible to spillage. This is especially true in the case of soap products, such as shampoo, where there is also the problem of water or other materials entering the opened bottle, thereby contaminating the product.

In addition to contamination and spillage, an open bottle is susceptible to becoming clogged around its neck from the remains of the product that adheres to the rim of the neck and dries out.

Further, when storing or shipping bottles having these conventional type closures, changes in the external pressure of the surrounding atmosphere will cause the bottles to deflect inwardly, making the bottle appear old and worn. Manufacturers, in attempting to overcome this atmospheric pressure problem, had to resort to using stronger, thicker bottles at greater costs.

Many attempts have been made to eliminate the problem of separate bottle and cap closures by constructing a cap which is permanently attached to the bottle and opens and closes automatically without the need of a separate closure.

Examples of such prior attempts are disclosed in U.S. Pat. No. 4,226,342, issued Oct. 7, 1980 and in U.S. Pat. No. 4,230,240, issued Oct. 28, 1980, both to Laauwe, which include dispensing caps for use on a squeeze bottle, wherein internal pressure causes a diaphragm forming the top of the cap to move up off of a seat comprising the upper opening, thereby dispensing the product. These and similar attempted modifications employ a stationary seat and a deflatable diaphragm or top. Such devices do not completely solve the problems of the prior-art, as they are subject to leakage even in the closed position, and do not eliminate the problem of clogging at the dispenser's opening.

In addition, these prior modifications do not adequately provide any means for recovery of the bottle shape after squeezing;—nor do they provide any adequate means to prevent premature dispensing of product from the bottle during shipping, except for the conventional shipping seal.

SUMMARY OF THE INVENTION

Accordingly, it is the object of the present invention to provide a squeeze container cap which automatically dispenses product upon the application of manual squeeze pressure, subsequently cutting off the flow of product upon release.

It is a further object of the invention to provide an automatic dispenser having a two-way valve which allows product to exit the container, and air to enter the container, thereby allowing the container to recover its shape after it has been squeezed.

It is a further object of the invention to provide a container cap which will dispense both viscous products, including liquids, soaps, shampoos, ketchup, mustard, syrup, glue, or the like, and non-viscous products, including toilet-bowl sprays, alcohol, water or other similar products, the latter being dispensed in a spray pattern.

It is a still further object to provide a container cap which can be adjusted so as to have a closed shipping position which can only be overcome by additional squeeze pressure over that required by dispensing.

These and other advantages are attained in a squeeze-type container having a composite closure which comprises a two-way dispensing valve. The valve-head comprises a disc which seats and closes against the edge of the vertically-directed spout at the upper end of the cap. The disc has a central bore employed as an air hole. A vertically disposed tubular stem depending axially from the underside of the disc supports a cruciform member in a plane substantially parallel to that of the disc. The internal portion of this composite valve-head is inserted into the mouth of the spout which is in the form of an inverted frustum of a cone with side walls which slant inwardly toward the top at an angle of about 45°.

In a preferred embodiment, an inverted cup-shaped check-valve is disposed concentrically with the tubular stem to close off the central bore in the valve-head disc. In dispensing position, the check-valve will seat in the tubular stem preventing product from flowing out through the tubular stem and central air bore. Also, upon external squeeze pressure, the disc will unseat from the mouth of the spout to dispense product. When squeeze pressure is released, the cruciform member acts like a spring, bearing against the 45° angular side walls of the container mouth, pulling the disc back to seat on the mouth edge, cutting off the flow of product. Simultaneously, air will enter the bottle through the central air bore and the tubular stem, because of the vacuum created by the exiting product, thereby unseating check-valve, and restoring the bottle to its original shape.

Viscous product will be dispensed in a steady flow, whereas less-viscous product will be dispensed in a spray pattern, the width of the spray being a function of the length of the dispensing spout.

In an alternative embodiment for use with a squeeze tube, the central air bore is eliminated, as there is no need for the tube to recover its original shape after squeezing. The stem in this embodiment is solid; and the need for the check-valve is eliminated.

It is contemplated that any bottle, container, or tube which can be manually deformed, can function with the automatic dispensing closure of the present invention.

Since the dispensing container may be operated in any inverted position, a container suitable for hanging in that position, having an integrally molded "hook" portion, can be employed as an alternative to a conventional "squeeze"-type container. This is especially useful when the container is employed to dispense shower soap or the like.

These and other objects, features and advantages of the present invention will be understood from a study of the specification with reference to the drawings.

SHORT DESCRIPTION OF THE DRAWINGS

FIG. 1 is an overall perspective showing of the composite two-way valve-head of the present invention seated in closed condition on the inverted conical spout of a cap disposed on a conventional squeeze bottle;

FIG. 5 is a top perspective view of the two-way valve-head of FIG. 2 diametrically sectioned;

FIG. 6 is a perspective view of the two-way valve-head of FIG. 2 looking up from below;

FIG. 7 is an overall perspective showing of the two-way valve-head of the present invention seated in closed condition on the spout of a cap disposed on a container of modified form, provided with a hook for hanging;

FIG. 8 is a perspective showing of the cap of the present invention in place on a squeeze tube; and FIG. 9 is a top perspective view of a modified two-way valve-head of the present invention designed to be used in combination with the squeeze tube of FIG. 8. The valve-head and check-valve are diametrically sectioned.

DETAILED DESCRIPTION OF THE DRAWINGS

Referring in detail to FIG. 1, there is shown the automatic dispensing cap 1 of the present invention disposed on a conventional bottle 5. The latter is one of a wide variety of flexible bottles, generally of plastic or the like, which can be squeezed, and when released, can restore to their original shapes.

The top of the cap 1 has a shipping seal 1*a* which closes the cap preventing premature dispensing of the enclosed product. Shipping seal 1*a* in the present invention is made of foil with an adhesive underside which sticks to the cap. Seal 1*a* is in the form of an ellipse, eccentrically placed on the cap 1 with an outwardly-extending lip which enables the seal to be grasped and removed. After the shipping seal is removed it can be discarded.

Figure 2:
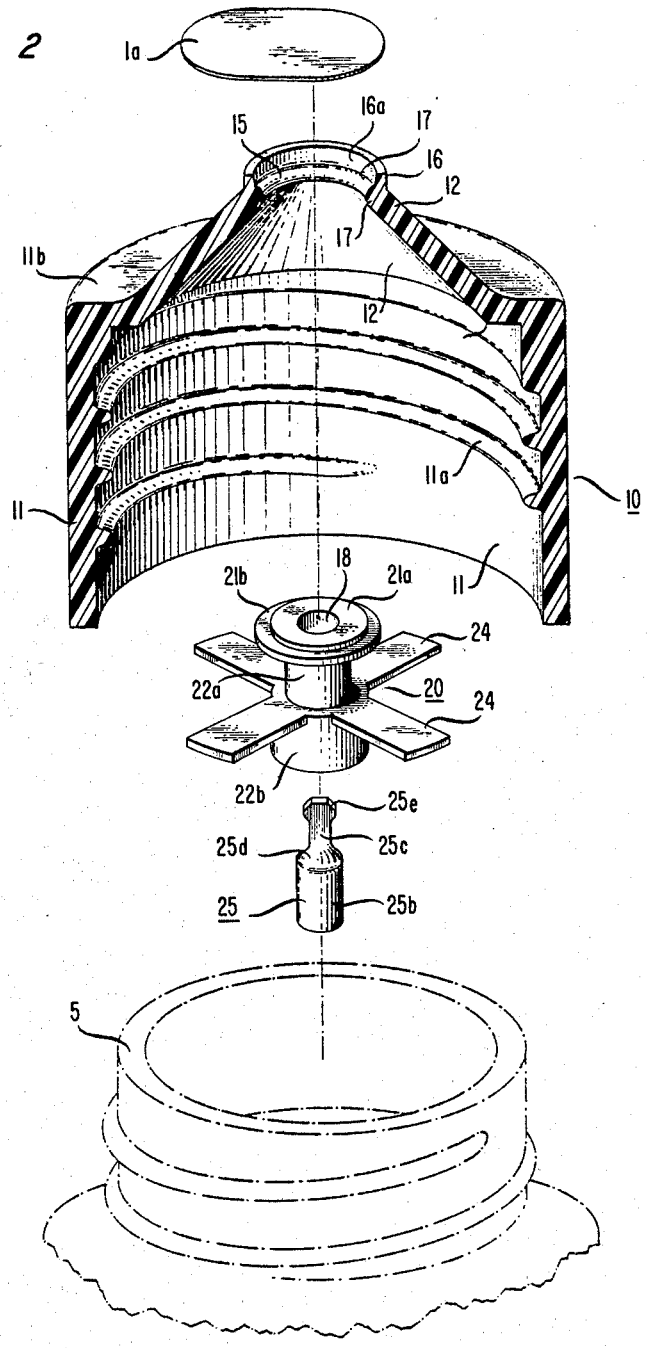
FIG. 2 is an exploded, perspective view of a preferred embodiment of the present invention including a composite two-way valve head in relation to an inverted conical spout designed to fit onto a conventional squeeze bottle.

FIG. 2 shows in enlarged, exploded view, the various elements of a preferred embodiment of the cap of the present invention with reference to the flexible bottle 5 (partially shown in phantom), the body portion 10 of cap 1 being shown in vertical section, the two-way valve-head 20 being shown in perspective; and the shipping seal 1*a* also being shown in perspective.

Figure 3:
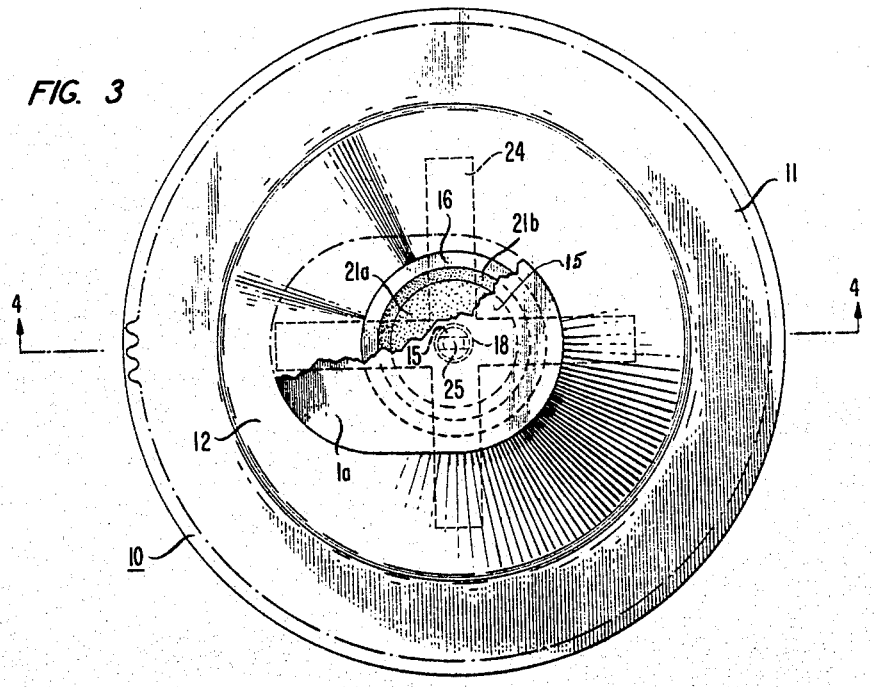
FIG. 3 is a top plan view of the composite two-way valve-head and cap of FIG. 2, in closed position.
Figure 4:
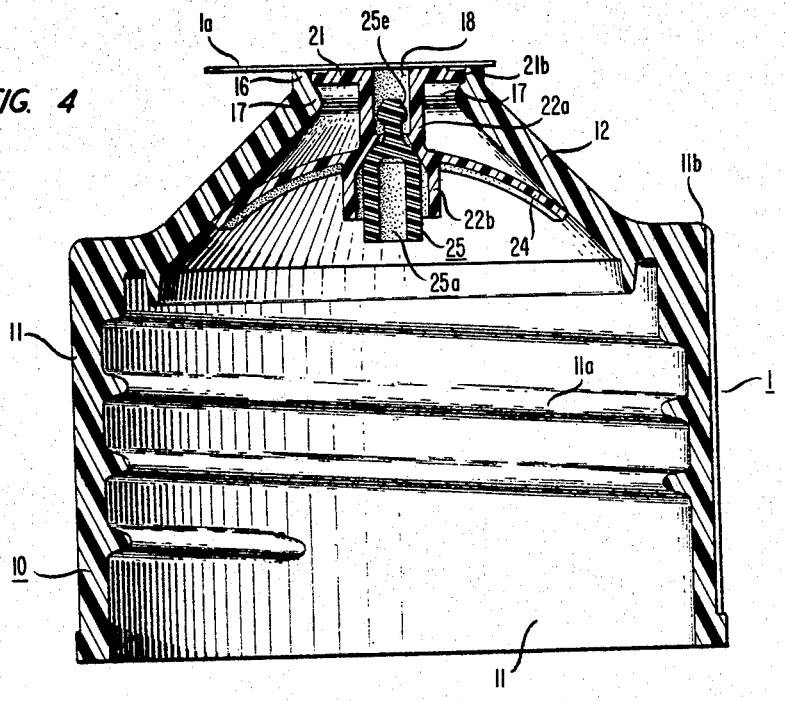
FIG. 4 is a vertical diametrical section of the two-way valve-head and cap of FIG. 2, in closed condition taken along the lines 4—4 of FIG. 3.

FIGS. 3 and 4 show respectively, an enlarged top plan view and vertical section of the automatic dispensing cap of FIGS. 1 and 2. The cap 1 has a hollow cylindrical main body 10 which can be made of any well-known rigid material, say, for example, polypropylene. The body 10 is roughly in the form of an inverted cup having an overall diameter of 1.070 inches, and a cylindrical side wall 11 which is about 0.050 inch thick and extends 0.690 inch parallel to the principal axis. In the present example, the side wall 11 is formed to include internal screw-threads 11*a* which are designed to mate with the externally screw-threaded container shown in FIG. 1. Alternatively, it is contemplated that any well-known means of mating the cap with the container, such as, for example, a snap-ring may be employed.

Extending beyond the shoulder 11*b* of side wall 11 and biased inward toward the mouth, forming a 45° angle with cylindrical side wall 11, is a frustoconical spout 12, directed outward parallel with the axis. The frustoconical wall of spout 12 has a wall thickness of 0.050 inch, and extends an additional 0.270 inch in an axial direction beyond the end of cylindrical side wall 11, to give the cap an overall height or axial length of 0.960 inch The upper end of conical spout 12 is truncated to form an axially disposed opening 15. The latter is defined by an annular lip 16, having an overall outer diameter of 0.305 inch. The inner surface, 16*a* is inwardly biased at an angle of 5°30′, so that the diameter of the opening is decreased from 0.250 inch at the outer end to 0.246 inch at its inner end, and having a thickness in an axial direction of 0.022 inch. This bias allows the two-way valve disc 20 to be force-fitted into the opening, as will be described hereinafter.

Adjacent the lower end of annular lip 16 is a rib 17 which protrudes 0.035 inch from the inside at the upper end of spout wall 12. Rib 17 constricts the upper opening to a diameter of 0.213 inch. The surface of rib 17 adjacent the surface 16*a* is stepped back at an angle of 45° so that it is disposed in a direction normal to the spout wall 12. Rib 17 acts as a seat for the disc portion 21 of the two-way valve-head 20 to be described hereinafter.

Seated in dispensing opening 15, is two-way valve-head 20, shown in exploded relation to the shell 10, and also in detail in top and bottom plan view respectively in FIGS. 5 and 6. Valve 20 is an integrally-formed composite member comprising a flexible material, say, for example, low density polyethelyne. The valve-head 20 has four sections: the disc 21 having the axially-depending tubular valve stem 22, cruciform supporting member 24, and inverted cup-shaped check-valve 25.

Disc 21 at the outer end of two-way valve-head 20 has an overall diameter of 0.249 inch, and a thickness of 0.025 inch. The diameter of disc 21 allows it to be force-fitted into dispensing opening 15, thereby to seat internally against the inwardly-angled surface of rib 17, which protrudes inwardly from opening 15. Since the side wall of disc 21 is normal to its principal surface, disc 21 seals against rib 17, forming an annular tangential seal. Disc 21 has a centrally located bore 18 0.062 inch in diameter which functions as an air hole to be described hereinafter.

Extending 0.244 inch normally from the underside of disc 21, is a tubular valve stem 22. The upper tube portion 22*a* forms a cylindrical chamber 0.106 inch long, conforming in internal diameter to bore 18, 0.100 inch in outside diameter. The lower portion 22*b* of tubular stem 22, extending down an additional 0.138 inch below the upper chamber, is wider than the upper section 22*a*, having an outer diameter of 0.162 inch and an inner diameter of 0.118 inch. The inside wall of stem 22 extending from plane 0.068 inch to 0.138 inch above the lower end, is biased inwardly at a 33° angle to the side wall to form a check-valve seat 22*c*. The upper edge 22*d* of seat 22*c* projects 0.005 inch inwardly from the inside wall of stem 22, forming an annular rib which acts as a stop for the check-valve to be described hereinafter.

Positioned to be seated in tubular stem 22 is check-valve 25, the lower portion of which is in the form of an inverted cup 25*a* having a cylindrical side wall 25*b*, and an upwardly-extending arm 25*c*. Cup portion 25*a* has a height of, say, 0.168 inch as measured from the top of its rounded shoulder 25*d* to its lower edge. Cup 25*a* has an inside diameter of 0.038 inch and an outside diameter of 0.088 inch. The cup 25*a* is hollowed to a depth of 0.137 inch at its upper end to remove much of the weight of the check-valve, enabling it to freely seat and unseat against valve seat 22*c* in the tubular stem 22*b*.

Upwardly-extending from rounded shoulder 25*d* of cup 25 and coaxial therewith, is arm 25*c* having an overall height of 0.070 inch, giving the check-valve 25 an overall height of 0.225 inch. Arm 25*c* has a diameter of 0.031 inch, terminating at its upper end in a projecting head 25*e* octagonal in form, having an overall diameter of 0.050 inch. The latter forms a stop or plug which supports check-valve 25 in place. When the cap 1 is in a non-dispensing position, check-valve 25 sits in tubular stem 22 with the underside of octagonal head 25*e* resting on inwardly-extended shoulder 22*d*. In a dispensing position of cap 1, check-valve 25 is forced in a seated position with the rounded shoulder 25*d* forced against conical check-valve seat 22*c* of tubular stem 22, as shown in FIG. 4.

A series of symmetrically disposed arms 23 0.0188 inch thick, and 0.075 inch wide, extend 0.206 inch in a radial direction from tubular valve stem 22, centered at a plane 0.114 inch below the under face of valve-head 21, coaxial with the frustoconical valve seat 22*c*. In the present embodiment four arms radiate from valve stem 22, disposed at 90° angles to one another to form a cruciform member 24. It is contemplated, however, that as few as three arms, or as many as six may be employed, as long as ample space remains between the arms to allow the product held in the container to pass out through valve opening. Cruciform member 24 performs the function of a spring, holding disc 21 in the seated position in opening 15.

The upper surface of disc 21 may include an annular flange 21*b* surrounding its edge. The latter has a diameter of 0.200 inch and is stepped down 0.002 inch below the surface of disc 21, leaving a raised platform 21*a*. When shipping seal is employed as a closure for the dispensing cap, platform 21*a* serves as a receiving surface for the adhesive side of seal 1*a*.

FIG. 7 shows in perspective, the automatic dispensing cap 1 of the type disclosed with reference to FIGS. 2–6 hereinbefore, positioned on a modified squeeze bottle 55. The latter is molded to include a "hook-shaped" indentation 56.

Since the automatic dispensing cap 1 is constructed to operate in inverted position, hooked indentation 56 allows the bottle 55 to be suspended in that position. A bottle of this type may have application for use with shampoo or other soaps, such as in a bath or shower.

FIG. 8 shows a modified form 31 of the dispensing cap of the present invention, positioned on a conventional squeeze tube 65. As there is no need for the squeeze tube 65 to recover to its original shape after dispensing product, the air hole 18 of FIG. 5 is eliminated; and the depending stem 42 corresponding to tubular stem 22, is solid. (See FIG. 8). In addition, there is no need for the check-valve 25, which is eliminated.

Referring to FIGS. 8 and 9, except as indicated, the parts of dispensing cap 31 are substantially similar to those described with reference to cap 1, 20 having been added to the designating numbers for similar parts. Thus, 41 indicates the top of the valve-head disc; 30 indicates the hollow cylindrical body portion of cap 31, and 32 indicates the frustoconical dispensing portion.

In FIG. 9, 41*a* and 41*b* represent the circular central and annular flanged portion of the valve-head disc 41; 42*a* and 42*b* represent the upper and lower cylindrical members depending from and coaxial with disc 41. 42*a* and 42*b* are similar in outer dimension and shape to the tubular portions 22*a* and 22*b* of FIG. 5, the principal difference being that they are solid. The cruciform member 44, which may comprise four arms, symmetrically spaced about and radiating outward from the central cylindrical members 42*a* and 42*b*, is similar in form and function to cruciform member 24 of FIGS. 5 and 6.

Operation of the Automatic Dispensing Cap of the Present Invention

Referring to FIGS. 1–4, the operation of the embodiment there shown, may be described as follows. The shipping seal 1*a* is removed and discarded; and the container 5 is inverted for use. The container is then squeezed, forcing product through the opening cruciform member 24, the pressure of which product unseats upper disc portion 21 of valve-head 20 from its lower seating position. Inasmuch as disc 21 is initially seated in a lower position against tapered side wall 16*a* of lip 16, the use needs to exert a squeeze pressure of only five to seven pounds per square inch to unseat the disc 21.

With the disc 21 unseated, a viscous product will then flow out upper opening 15. If a non-viscous product, such as water or alcohol, is employed, the product will be dispensed as a fine, uniform spray. The radius of this spray pattern can be decreased by providing a longer lip 16, so that the spray will be more narrowly defined. Under squeeze pressure, the shoulder 25*d* of check-valve 25 will be seated against the frustoconical check-valve seat 22*a*, preventing product from flowing out of tubular stem 22 and air hole 18.

Upon release of squeeze pressure, the cruciform member 24 will act as a spring, pulling back disc 21 into a seated position in opening 15, thereby cutting off the flow of product. Disc 21 will now be reseated in an upper position on the tapered side wall 16*a* of lip 16.

If the user desires, say, for travel purposes, to have the disc 21 in a lower seated position to prevent premature dispensing, the disc may be manually pushed down into the lower seated position against rib 17 by the user's finger. From the lower position it will again take a slightly larger pressure, say, 10 pounds per square inch, to dispense the product.

After the squeeze pressure is released, the squeeze container 5 will be restored to its original shape by air entering the bottle through air hole 18. The vacuum created in the bottle will draw air back in through the air hole 18, and tubular stem 22*a*, 22*b*, unseating check-valve 25, and allowing air to pass into the bottle.

When employing a squeeze tube of the form of 65, the air hole 18, and check-valve 25 are eliminated from the cap 31; and as previously stated, the stem 22*a*, 22*b* is solid, as there is no need for the tube 65 to recover its shape. Otherwise, operation of cap 31 is the same as that described with reference to cap 1.

It will be understood, that although several embodiments have been described by way of illustration, the invention is not limited by the forms or specific dimensions disclosed by way of illustration, but only by the scope of the appended claims.

What is claimed is:

1. A cap, for dispensing product contained in a squeeze container having a mouth at one end, comprising in combination:

a hollow body portion with a circular section substantially symmetrical about a central axis, having at one end an enlarged opening including means for connecting said body portion in liquid-tight relation to the mouth of said container, and having at its other end a frustoconical outwardly-projecting spout tapering from a larger internal diameter to a smaller outer spout opening symmetrically disposed about said axis;

a valve-head comprising a disc for seating in liquid-tight relation against the outer edge of said smaller spout opening, a stem with one end centered on the inner face of said disc and projecting into said frustoconical spout along said central axis, a plurality of resilient flexible members fixed to and extending radially outward from the surface of said stem adjacent its inner end, the outer ends of said flexible members being curved in outwardly-directed convex relation to the principal axis of said hollow body portion, and with their ends bearing against the inner surface of said frustoconical spout in tangential relation thereto;

wherein said valve-head disc is responsive to squeeze pressure exerted on said container to unseat from said spout opening, and wherein said plurality of resilient members is constructed and arranged to provide spring bias between said valve-head and the inner surface of said frustoconical spout which operates to reseat said valve-head disc on said spout opening upon release of said squeeze pressure.

2. The combination in accordance with claim 1 wherein:

the wall of said frustoconical spout projects outwardly from said hollow body portion, forming a 45° angle directed toward the axis thereof; and wherein said plurality of resilient members is symmetrically arranged around the stem.

3. The combination in accordance with claim 1 wherein:

said cap includes, in addition to said spout opening, at least one air passage, including means constructed and arranged to operate on the inside of said cap to form a fluid-tight seal closing said air passage in response to squeeze pressure on said container, and to inwardly deflect automatically to allow air to enter said container after said squeeze pressure is released, thereby restoring said squeeze container to its original shape.

4. The combination in accordance with claim 3 wherein said valve-head comprising said disc is tubular, and wherein said at least one air passage comprises a central air bore along the axis of said valve-head including said stem, and wherein said means constructed and arranged to operate on the inside of said cap to form a fluid-tight seal comprises a check-valve which is disposed to seat in a sealed position in said central air bore in response to the application of external squeeze pressure on said container, thereby cutting off the flow of product and air into said air bore, and to unseat from said sealed position when the external application of said squeeze pressure is relaxed, thereby permitting the flow of air through said air bore into said container to restore the shape of said container.

5. The combination in accordance with claim 4 wherein said tubular valve-head comprises a first axially-disposed air bore of a first diameter adjacent its outer end extending inwardly from said disc, and a second axially-disposed air bore adjacent its inner end concentric with said first air bore, and having a second diameter substantially larger than said first diameter, said first and second air bores being interconnected by an outwardly-directed frustoconical neck portion having an inner wall angled in the direction of the principal axis of said tubular valve-head, said neck portion forming at the inner end of said first air bore an inwardly projecting bore shoulder forming an internal check-valve stop, and wherein said check-valve comprises a body having at its inner end a cylindrical portion of a diameter which is less than said second diameter but substantially exceeding said first diameter, said check-valve being rounded near its upper end to form an annular check-valve shoulder portion, and having axially disposed at the center of said check-valve shoulder portion an outwardly-extended stem terminating in a head symmetrically disposed on the outer end of said stem, said head having a diameter which is less than said first diameter but exceeding the diameter of said check-valve stop;

whereby in response to squeeze pressure on said container said check-valve is forced to move outwardly so that said check-valve shoulder seals against the inner wall of said frustoconical neck, and in response to a release of said squeeze pressure said check-valve unseals, moving inwardly until it reaches said check-valve stop to admit the passage of air through said first and second air bores into said container.

6. The combination in accordance with claim 5 wherein the inner cylindrical portion of said check-valve is hollow in the form of a cup.

7. The combination in accordance with claim 1 wherein:

said plurality of resilient flexible members is substantially in cruciform array comprising four arms of equal length, respectively spaced-apart at angles of about 90°.

8. The combination in accordance with claim 1 wherein:

said plurality of resilient members comprises three arms of substantially equal length respectively spaced-apart at angles of about 120°.

9. The combination in accordance with claim 1 wherein:

said plurality if resilient members comprise six arms of substantially equal length each respectively spaced-apart at angles of about 60°.

10. The combination in accordance with claim 1 further comprising in combination:

an outwardly-extending spout rim surrounding said symmetrically-disposed spout opening, said spout rim including an inside wall having an angular bias wherein the inner diameter of said spout rim, at its outer edge, is greater than the inner diameter of said spout rim at its inner periphery adjacent said spout opening;

said valve-head disc having a cylindrical side wall, and an outer diameter equal to the inner diameter of said spout rim at its outer edge; and wherein said valve-head disc has two seated positions, the first seated position adjacent the outer edge of said spout rim, requiring squeeze pressure not exceeding 5 to 7 pounds per square inch, to unseat said valve-head disc, and a second seated position adjacent said inner periphery of said spout rim requiring squeeze pressure of substantially 10 pounds per square inch to unseat said valve-head disc.

11. The combination in accordance with either claims 1 or 10, wherein said cap is constructed to dispense a viscous product in a steady flow.

12. The combination in accordance with claim 1 wherein:

said cap is constructed to disperse a non-viscous product in a uniform spray pattern.

13. The combination in accordance with claim 10 wherein:

said cap is constructed to disperse a non-viscous product in a uniform spray pattern, the diameter of the spray pattern being inversely proportional to the axial length of said spout rim.

14. The combination in accordance with claim 1 wherein:

said valve-head disc includes a disc-shaped seal-receiving platform, centrally located and embossed on the surface of said valve-head disc;

said seal-receiving platform constructed and arranged to receive a shipping seal having one adhesive surface for adhering to said seal-receiving platform.

15. The combination in accordance with claim 1 wherein said valve-head, including said disc, said stem, and said plurality of flexible members, is integrally formed as a substantially solid body of resilient material.

16. An apparatus for dispensing fluid product which comprises in combination:

a flexible squeeze container for containing said product, said container having a mouth at one end, and being constructed and arranged to compress inwardly upon application of external squeeze pressure;

a dispensing cap including a hollow body portion with a circular section substantially symmetrical about a central axis, having at one end an enlarged opening connected in liquid-tight relation to the mouth of said flexible container, and having at its other end a frustoconical outwardly-projecting spout including a spout opening symmetrically disposed about said axis;

a valve-head comprising a disc for seating in liquid-tight relation against the outer edge of said spout opening, a stem with one end centered on the inner face of said disc and projecting into said frustoconical spout along the central axis thereof, a plurality of resilient flexible members fixed to and extending radially outwardly from the surface of said stem adjacent its other end, the outer ends of said flexible members being curved in outwardly-directed convex relation to the principal axis of said hollow body portion, the end portions of said flexible members bearing against the inner surface of said frustoconical spout in slideable tangential relation thereto;

wherein said valve-head disc is responsive to squeeze pressure exerted on said flexible container to unseat from said spout opening, and wherein said plurality of resilient members is constructed and arranged to provide spring bias between said valve-head and the inner surface of said frusto-conical spout, thereby operating to reseat said valve-head disc on said spout opening upon release of said squeeze pressure.

17. The combination in accordance with claim 10 wherein:

said flexible container includes, adjacent its lower end, a hook-shaped indentation, from which said container may be hung in inverted position.

18. The combination in accordance with claim 16 wherein said valve-head comprising said disc is tubular, and is formed to include a central air bore along the axis of said valve-head and said stem, and means constructed and arranged to operate on the inside of said tubular cap to form a fluid-tight seal, which means comprises a check-valve disposed to seat in a sealed position in said central air bore in response to the application of external squeeze pressure on said flexible container, thereby cutting off the flow of product and air into said air bore, and to unseat from said sealed position when the external application of said squeeze pressure is relaxed, thereby permitting the flow of air through said air bore into said flexible container in a reverse direction to restore the shape of said container.

19. An apparatus for dispensing product which comprises in combination a deformable squeeze tube having a mouth at one end, and being constructed and arranged to be permanently inwardly deformed upon the application of external squeeze pressure;

a dispensing cap including a hollow body portion with a circular section substantially symmetrical about a central axis, having at one end an enlarged opening connected in liquid-tight relation to the mouth of said deformable container, and having at its othe end a frustoconical outwardly-projecting spout including a spout opening symmetrically disposed about said axis;

a valve-head comprising a disc for seating in liquid-tight relation against the outer edge of said spout opening, a stem, one end centered on the inner face of said disc and projecting into said frustoconical spout along the central axis thereof; a plurality of resilient flexible members fixed to and extending radially outward from the surface of said stem adjacent its inner end, the outer ends of said flexible members being curved in outwardly-directed convex relation to the principal axis of said hollow body portion, the ends of said resilient members bearing against the inner surface of said frustoconical spout in tangential relation thereto;

wherein said valve-head disc is responsive to squeeze pressure exerted on said container to unseat from said spout opening, and wherein said plurality of resilient members is constructed and arranged to provide spring bias between said valve-head and the inner surface of said frustoconical spout thereby operating to reseat said valve-head disc on said spout opening upon release of said squeeze pressure.

20. The combination in accordance with claim 19 wherein said valve-head, including said disc, said stem and said plurality of resilient flexible members is integrally formed as a substantially solid body of resilient material.

21. A valve-head for seating a spout opening in a dispensing cap having a frustoconical spout and an enlarged opening for connection with a mouth of a squeeze container, comprising in combination:

a valve-head disc for seating in liquid-tight relation against the outer edge of said spout opening;

a stem with one end centered on the inner face of said disc and constructed to project into said frustoconical spout along a central axis thereof; and a plurality of resilient flexible members fixed to and extending radially outward from said stem adjacent the other end thereof, said members being constructed and arranged to slideably engage an inner wall of said spout with the end portions of said members in slideable tangential relation thereto;

wherein said valve-head disc is constructed to respond to squeeze pressure exerted on said container to unseat from said spout opening, and wherein said plurality of resilient members are constructed to provide spring bias to reseat said valve-head on said spout opening upon release of said squeeze pressure.

22. The combination in accordance with claim 21 wherein:

said plurality of resilient flexible members is substantially in cruciform array having four arms of equal length, respectively spaced-apart at angles of about 90°.

23. The combination in accordance with claim 21 wherein:

said plurality of resilient members comprises three arms of substantially equal length respectively spaced-apart at angles of about 120°.

24. The combination in accordance with claim 21 wherein said valve-head comprising said disc and said stem is tubular, comprising a central air bore along the axis of said valve-head and said stem; and means constructed and arranged to operate on the inside of said cap to form a fluid-tight seal, said means comprising a check-valve which is disposed to seat in a sealed position in said central air bore in response to the application of external squeeze pressure on said container, thereby cutting off the flow of product and air into said air bore, and to automatically unseat from said sealed position when the external application of said squeeze pressure is relaxed, thereby permitting the flow of air through said air bore into said container to restore the shape of said container.

25. The combination in accordance with claim 21 wherein said valve-head, including said disc, said stem and said plurality of resilient flexible member, is integrally formed as a substantially solid body of resilient material.

26. The combination in accordance with claim 21 wherein:

said plurality of resilient members comprises six arms of substantially equal length respectively spaced-apart at angles of about 60°.

27. The combination in accordance with claim 21 wherein:

said valve-head disc includes a disc-shaped seal-receiving platform, centrally located and embossed on said valve-head disc;

said seal-receiving platform constructed and arranged to receive a shipping seal having one adhesive surface for adhering to said seal-receiving platform.

* * * * *